United States Patent [19]

Krogstrup et al.

[11] Patent Number: 4,955,656

[45] Date of Patent: Sep. 11, 1990

[54] GRIPPING DEVICE FOR NAPPY MATERIALS

[75] Inventors: Johan Krogstrup, Kibaek; Henning Nohr, Kolding; Bruno Christensen, Egtved; Frank Fosnaes, Kolding, all of Denmark

[73] Assignee: Tex-Matic ApS, Kibaek, Denmark

[21] Appl. No.: 339,146

[22] Filed: Apr. 17, 1989

[30] Foreign Application Priority Data

Apr. 19, 1988 [DK] Denmark ..... 2115/88
Dec. 15, 1988 [DK] Denmark ..... 6959/88

[51] Int. Cl.[5] ..... B65H 3/22; B65H 3/48

[52] U.S. Cl. ..... 294/100; 271/18.3; 271/97; 414/795.5; 414/796.9

[58] Field of Search ..... 271/19, 18.3, 97; 414/795.5, 796.9, 797, 13; 294/61, 100

[56] References Cited

U.S. PATENT DOCUMENTS 3,588,091 6/1971 Stone, III et al. ..... 271/19
4,386,770 6/1983 Hellin ..... 294/61 X
4,645,193 2/1987 Walton et al. ..... 414/796.9

FOREIGN PATENT DOCUMENTS 2108401 9/1972 Fed. Rep. of Germany .
3433725 7/1985 Fed. Rep. of Germany .
210395 6/1984 German Democratic Rep. ... 271/19

*Primary Examiner*—Robert J. Spar
*Assistant Examiner*—Janice Krizek
*Attorney, Agent, or Firm*—Lee, Mann, Smith, McWilliams & Sweeney

[57] ABSTRACT

A gripping device for nappy workpieces which is capable of handling both small and large pieces of textile materials. A gripping device is provided having a base part and a slidable part, between which is provided a substantially closed hollow to which pressurized gas is supplied through a series of slots. The slidable part is moved in such a manner that the slots are squeezed together and the gripping device grips the nap of the upper piece of textile material. Pressurized gas is led through the upper piece to the piece lying immediately below to ensure efficient separation of the upper piece from the piece below, and avoiding the inadvertant lifting of more than one piece at a time.

5 Claims, 3 Drawing Sheets

GRIPPING DEVICE FOR NAPPY MATERIALS

Figure 1:
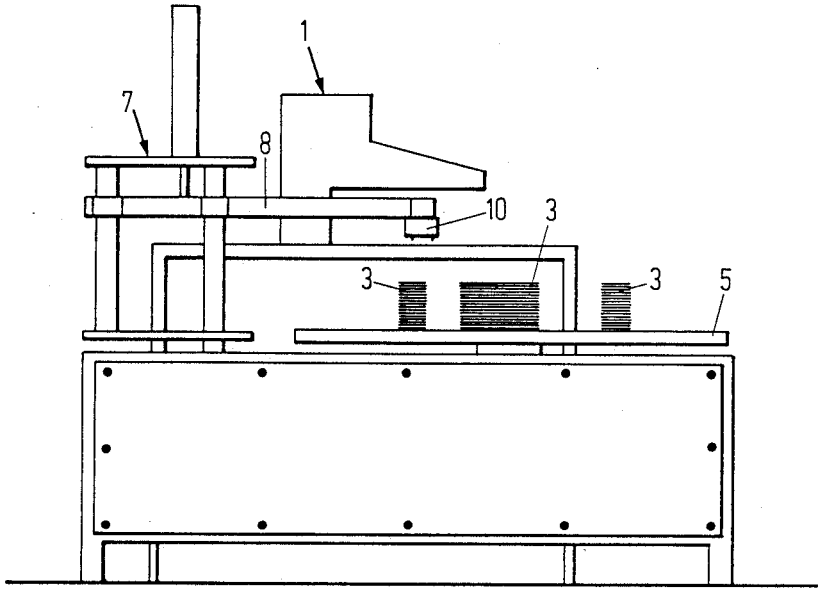

The invention relates to a gripping device for nappy workpieces, the device comprising a base part, one or more gripping means and a part being slidable relative to the base part and provided with a squeeze means for each gripping means in that the gripping means are shaped as elongate bodies which in an area close to their first ends adapted for contact against work-pieces are surrounded by the squeeze means and slotted along the longitudinal axis and by their other ends are fixed against translatory movements in the longitudinal direction relative to the base part and where the slots in the gripping means may be squeezed by the movement of the slidable part towards the work-piece. By nappy work-pieces there is primarily meant textiles but also other flexible materials with hair, nap, fibres or threads protruding from the surface of the material are included in this definition.

Such a gripping device is known from DE publication No. A1 34 33 725 (Aurich et al). This specification describes a method and a device for separating stacked pieces of textile. The known gripping device, however, only forms a constituent part of a large gripping apparatus which is comparatively spacious and of a complicated design. The known apparatus is provided with a spring-loaded presser foot which during the first step of the gripping operation engages a section of the surface of the upper piece in the stack of pieces of textile. At the same time the gripping device engages said upper piece. The load exerted by the presser foot causes a deformation of the entire stack thereby creating some relative displacement between the upper layers. At the same time the squeeze devices are slid down whereby the gripping means will grip the nap and the gripping device will then pull up a section of the upper piece while another section of the upper piece is kept down by the presser foot. Then the entire apparatus is lifted up till the presser foot is clear of the stack. The separation itself between the upper and the underlying piece of textile is produced by a separate air nozzle blowing compressed-air along and between the upper and the underlying piece. The device described above is primarily intended for large pieces and is particularly suitable for work-pieces having long fine fibres which are inclined to connect between the layers. Moreover, the known gripping device leaves no visible marks on the handled work-pieces just as various types of textiles may be handled without the need for adjusting the gripping means. Using the described gripping apparatus it is not possible to handle small pieces of textile as badges, pocket-pieces etc. just as the complicated design prevents use thereof in places with limited height such as in automatic sewing machines.

A gripping device having certain features in common with the device described above is known from DE laid-open publication (auslegeschrift) No. 21 08 401 (Stone). Each gripping means is provided with a set of gripping fingers corresponding to the slotted part of the gripping means described above and being slidably mounted in a housing. By means of a piston in the housing the gripping fingers may be pushed down towards the work-piece to be gripped while the internal shape of the housing will cause the fingers to be pushed towards each other permitting a fold to be made in the piece of textile between the fingers. The gripping device thus disclosed may be connected to a source of compressed air, which may be supplied in the housing in order to let go of the piece of textile in the final part of a handling operation. Due to the downwards movement towards the work-piece there is a risk that the fingers will leave marks in the piece of textile, eventually penetrating the piece. Moreover, the structure of these gripping devices is complicated causing heavy manufacturing costs.

It is the object of the invention to provide a gripping device as described in the introduction and which is not encumbered with the drawbacks of the known devices, i.e. is capable of handling both small and large pieces of textile and at the same time is simpler and cheaper and making possible a more compact design than the known devices but which may nevertheless securely grip and handle nappy materials of many different types, particularly in lifting and separation of individual pieces from a stack.

This is achieved according to the invention by a gripping device of the kind described above where between the base part and the slidable part there is provided a substantially closed hollow to which pressurized gas may be supplied through the base part, the extent of the slots, the squeeze means and/or the slidable part being shaped and relatively arranged in such a manner that the pressurized gas in the hollow is preferably discharged through the section of the slots being closest to the hollow to leave the slots by the first ends of the gripping means.

Due to the hollow compressed air or the like may be supplied to the gripping device via a single inlet opening into the hollow from where the air may be distributed to several gripping means. The slidable part is moved in such a manner that the slots are squeezed together and the gripping means will grip the nap of the upper piece. At this moment pressurized gas may automatically be led through the base part into the hollow and from there further on through the slots and out through the gripping means. This will send the pressurized gas through the upper piece to hit the piece being second from the top and lying immediately below. This will ensure efficient separation of the upper piece from the one immediately below and it is thus avoided that more then one piece is lifted by the handling.

In a preferred embodiment of the gripping device according to the invention as stated in claim 2, the base part has a skirt or protruding annular edge, which surrounds the slidable part.

In order to permit easy replacement of the gripping means it is preferred that the device is designed as disclosed in claim 3 where by the ends thereof fixed relative to the base part the gripping means are provideed with a recess, undercut or some other cross-sectional reduction wherein a slot provided in a locking means connected to the base part may rest in a locking position for locking engagement of the locking means, where the locking means is connected the base part in such a manner that it may be released to describe a movement transversely to the longitudinal axis of each gripping means between the locking position and a free position permitting the gripping means to be removed from the gripping device.

In order to permit separate replacement of the gripping means the device is designed as disclosed in claim 4 where there is a locking means for each gripping means and that by means of a shaft the locking means is rigidly connected to a control lever arranged on the face of the device opposite the gripping means.

Figure 2:
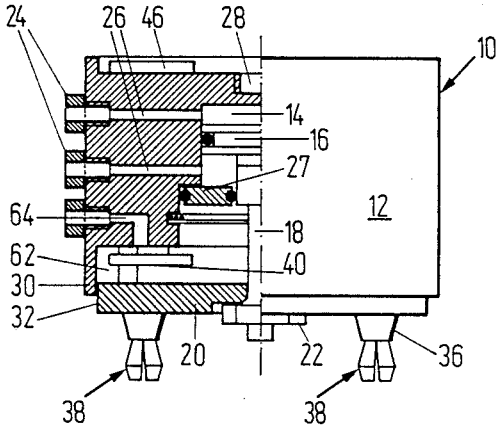
Figure 3:
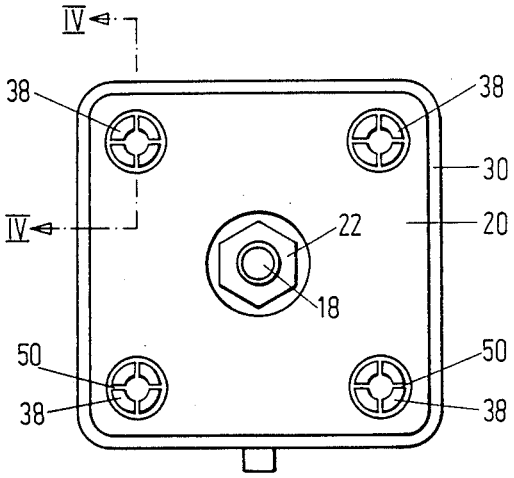
Figure 4:
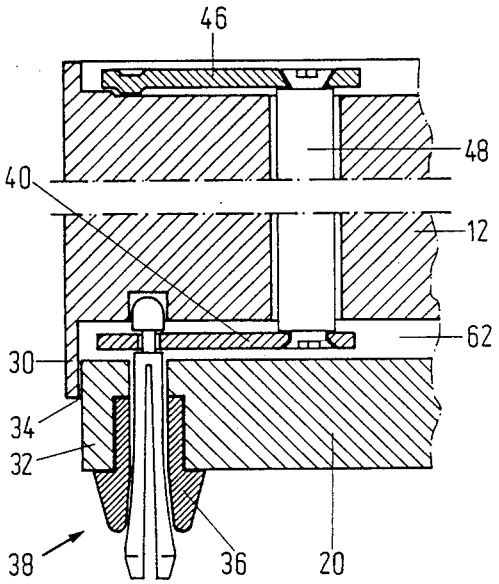
Figure 5:
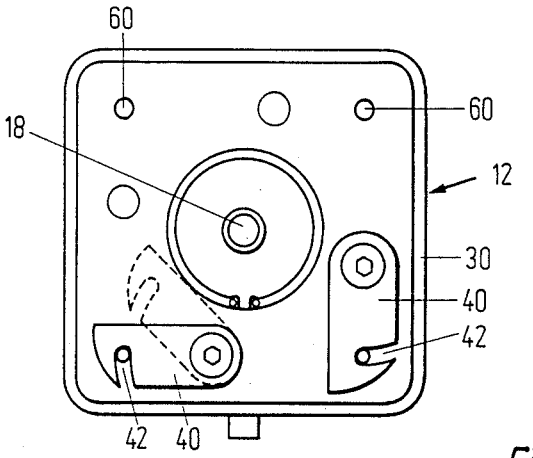
Figure 6:
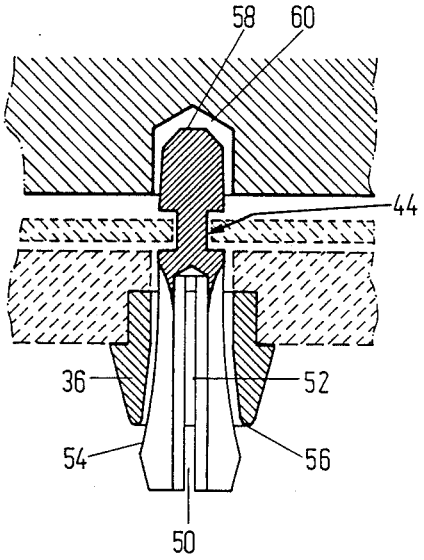

An embodiment of the invention will now be further described with referece to the drawing wherein FIG. 1 is a work station applying the gripping device according to the invention, FIG. 2 is a side view and partly sectional view of a preferred embodiment of the invention, FIG. 3 is a bottom view of FIG. 2, FIG. 4 is a detailed section of the gripping device showing a gripping means complete with locking device, FIG. 5 is identical to FIG. 3 but where the slidable part and gripping means have been removed, and FIG. 6 is an enlarged section of a gripping means and a squeeze means.

A preferred embodiment of the gripping device according to the invention is shown in FIG. 1, where a sewing work station consisting of an automatic sewing maching 1 may be supplied with various pieces of textile from stacks 3 arranged on a rotatable table 5. The stacks 3 are placed along the periphery of the table 5 which by turning thereof about a vertical axis will bring a stack 3 within reach of a handling robot 7 having an arm 8 at the end of which the gripping device 10 is mounted.

The preferred embodiment of the gripping device 10 consists of a base part 12, for example made of aluminium, incorporating a pneumatic cylinder 14 with a piston 16 and a threaded piston rod 18 screwed into a slidable part 20. The part 20 is locked by a lock nut 22. Compressed air for the piston movement is supplied via pipe branches 24 and is led to the cylinder via passages 26. A cover 27 with packings closes the cylinder 14. The cover 27 may be locked with a locking ring.

The base part 12 may be provided with a threaded hole 28 for screw mounting in the robot arm 8; this will give the smallest possble overall height of the gripping device 10.

Other ways of mounting are possible; for example, a not shown top plate which is mounted with screws in the base part may be provided with a central bore in which there is provided a screw with countersunk head with its threaded shaft pointing upwards. In the latter case the top plate is first mounted on the robot arm with the central screw whereafter the base part is secured to the top plate with the remaining screws.

The base part 12 has a circumferential web 30 enclosing the edge 32 of the slidable part 20 in such a manner that the slot 34 between the web 30 and the part 20 becomes very small and therefore relatively air-tight. In the slidable part 20, which in this embodiment is substantially square, there is mounted closed to the edge 32 and at each corner a bushing 36 held by a press fit in through-holes in the part 20. In each bushing 36 are arranged gripping means or qrippers 38 which are retained by locking plates 40. A slot 42 in each of the locking plates 40 may engage an undercut, called neck 44 on each gripper 38. The locking plates 40 may be swung out of engagement with the necks 44 by means of a central lever 46 on the upper side of the base part in that a shaft 48 connects locking plates 40 and control lever 46.

Each gripper 38 which is preferably made of round brass rods has four slots 50 and a central bore 52. The number of slots 50 may of course be another, practically from two to six. The slots 50 as well as the bore 52 almost reach to the neck 44. Close to the free ends of the grippers 38 there is provided a conical face 54 which by the movement of the slidable part 20 is actuated by the internal face or lower edge 56 of the bushing 36 arranged in the part 20. Preferably, the internal part of the bushing 36 closest to the face 54 widens gently to reduce wear on the edge 56. To reduce friction and to increase wearability bushings 36 as well as gripping means 38 are nickel-plated by a chemical process (chemical nickel-plating). It is noted that the grippers 38 by the manufacturing of slots 50 by sawing or milling are biased to their open position as shown in the figures, thereby tending to push the piston 16 to its upper position as seen in FIG. 2.

The head 58 of each gripper 38 is preferably chamfered as to catch guide holes 60 having the purpose to secure the grippers 38 against sideways motion.

Designed in this manner there is formed a substantially closed hollow 62 between base part 12 and slidable part 20. Pressurized gas, preferably compressed air, may be supplied to the hollow 62 through channel 64 in the base part 12. The channel 64 provides also the possibility of supplying vacuum to the hollow 62 in order to suck air through grippers 38 and thereby raising the nap of the work-piece.

The function of the gripping device is as follows. The device 10 mounted on the robot arm 8 is brought into contact with a stack 3 on the table 5. Eventually vacuum is supplied through channel 64 as described above. Thereafter the cylinder 14 is filled with compressed air from an automatic controlled source as to force the piston 16 and thereby the part 20 downwards as seen in FIG. 2, thereby causing bushings 36 to close grippers 38. Thus the nap of the work-piece is caught, and compressed air is then supplied through channel 64 to fill hollow 62. The total fluid-dynamic resistance through the section of slots 50 near the hollow 62 and the central bore 52 is lesser than the corresponding resistance through the slot 34 around the slidable part 20, which is why the greater part of the compressed air leaves the grippers 38 through the lower section of bore 52 and slots 50. As the upper work-piece in the stack is held by the grippers 38 some of the air penetrates it and impinges on the under-lying piece in the stack 3, thereby separating the two pieces. At the same time, robot arm 8 lifts device 10 with work-piece and places work-piece under the sewing-machine 1. The device 10 lets go of the work-piece by moving the piston 16 upwards as seen in FIG. 2, the grippers 38 thereby returning to their open position. This operation may be assisted by blowing air through grippers 38 as described above.

The device according to the invention may be utilized in other configurations, e.g. when handling larger workpieces, by placing several gripping devices along a rod as to pull material from rolls, or placing gripping devices in different geometrical configurations as to handle different shaped pieces of textile.

Other embodiments of the invention are of course possible, for example that the gripping device may have cylindrical shape, the locking means may correspondingly be a flat ring with locking slots in connection with holes of greater dimension than the slots in order to allow passage of the gripper heads.

I claim:

1. Gripping device for nappy work-pieces comprising a base part, one or more gripping means, and a part slidable relative to the base part and provided with a squeeze means for each gripping means, the gripping means being shaped as elongate bodies which in an area close to their first ends adapted for contact with work-pieces are surrounded by the squeeze means and having slots along a longitudinal axis and at their second ends are fixed against translatory movements in a longitudinal direction relative to the base part and where the gripping means are squeezed by the movement of the slidable part towards the work-piece, characterized in that between the base part and the slidable part there is provided a substantially closed hollow to which pressurized gas may be supplied through the base part and that the slots, the squeeze means and the slidable part are shaped and relatively arranged in such a manner that the pressurized gas in the hollow is discharged mainly through the section of the slots closest to the hollow to leave the slots by the first ends of the gripping means.

2. Gripping device according to claim 1, characterized in that the base part has a skirt or protruding annular edge, which surrounds the slidable part.

3. Gripping device according to claim 1, characterized in that the gripping means are shaped with a recess, undercut or some other cross-sectional reduction at their second ends wherein a slot provided in a locking means connected to the base part may rest for locking engagement of the locking means and in that the locking means is connected to the base part in such a manner that it may be released to describe a movement transversely to the longitudinal axis of each gripping means between a locking position and a free position permitting the gripping means to be removed from the gripping device.

4. Gripping device according to claim 1, characterized in that there is a locking means for each gripping means and that by means of a shaft the locking means is rigidly connected to a control lever arranged on a face of the device opposite the gripping means.

5. Gripping device according to claim 2, characterized in that there is a locking means for each gripping means and that by means of a shaft the locking means is rigidly connected to a control lever arranged on a face of the device opposite the gripping means.

* * * * *